US010940686B2

(12) United States Patent
Adachi et al.

(10) Patent No.: US 10,940,686 B2
(45) Date of Patent: Mar. 9, 2021

(54) INTEGRATED CIRCUIT DEVICE AND LIQUID DROPLET EJECTION DEVICE

(71) Applicant: SEIKO EPSON CORPORATION, Tokyo (JP)

(72) Inventors: Kazuhiro Adachi, Chino (JP); Takashi Nakajima, Matsumoto (JP); Katsumi Okina, Fuchu (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/566,142

(22) Filed: Sep. 10, 2019

(65) Prior Publication Data

US 2020/0079079 A1 Mar. 12, 2020

(30) Foreign Application Priority Data

Sep. 11, 2018 (JP) ..... JP2018-169287

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2002/14411* (2013.01)

(58) Field of Classification Search
CPC ..... B41J 2/04541; B41J 2/045821; B41J 2/04588; B41J 2002/14411
See application file for complete search history.

(56) References Cited

U.S. PATENT DOCUMENTS 7,599,247 B2 * 10/2009 Asauchi ..... G06F 21/79 365/185.18
9,505,212 B2 * 11/2016 Takagi ..... B41J 2/04541
2006/0001754 A1 1/2006 Yanagisawa et al.

FOREIGN PATENT DOCUMENTS

| | | | |
|---|---|---|---|
| EP | 1600294 | A1 | 11/2005 |
| JP | H11-86583 | A | 3/1999 |
| JP | 2006-019971 | A | 1/2006 |
| JP | 5952575 | B2 | 7/2016 |
| WO | 2004/076180 | A1 | 9/2004 |

* cited by examiner

*Primary Examiner* — Dinh T Le
(74) *Attorney, Agent, or Firm* — Oliff PLC

(57) ABSTRACT

An integrated circuit device includes a terminal, a switch circuit, an amplifier circuit, a voltage boosting circuit, and a control circuit. The terminal is connected to a driving signal line of a driving circuit that drives an actuator of a liquid droplet ejection head. One end of the switch circuit is connected to the terminal. The amplifier circuit receives an output signal from the other end of the switch circuit, and amplifies an induced voltage of the actuator after the actuator having been driven. The voltage boosting circuit generates a boosted voltage for level-shifting a switching signal of the switch circuit based on the step-up clock signal.

13 Claims, 10 Drawing Sheets

INTEGRATED CIRCUIT DEVICE AND LIQUID DROPLET EJECTION DEVICE

The present application is based on, and claims priority from JP Application Serial Number 2018-169287, filed Sep. 11, 2018, the disclosure of which is hereby incorporated by reference herein in its entirety.

BACKGROUND

1. Technical Field

The present disclosure relates to an integrated circuit device, a liquid droplet ejection device, and the like.

2. Related Art

An ink-jet printer that prints an image by discharging ink droplets from a plurality of nozzles is known as an example of a liquid droplet ejection device. A nozzle of the ink-jet printer includes an actuator such as a piezo element, and as a result of applying a driving signal to the actuator, the actuator causes the nozzle to discharge ink. When an anomaly occurs in the nozzle, there is a risk that ink is not properly discharged, and it is possible that anomalous printing may occur in which a line is printed in a print image, for example.

There is a method in which residual vibration of an actuator is monitored as a method for detecting such an anomalous nozzle. After the actuator has been driven by a driving signal, residual vibration occurs in the actuator. Because a voltage is generated in the actuator due to this residual vibration, an anomalous nozzle can be determined based on the waveform of the induced voltage. For example, when an anomaly occurs in a nozzle, the frequency or the amplitude of the residual vibration changes, and therefore an anomalous nozzle can be determined by detecting such changes. This kind of method is disclosed in WO2004/076180, for example. A liquid droplet ejection device in WO2004/076180 includes a controller, a head unit, a head driver that drives the head unit based on a signal from the controller, and an anomalous ejection detection means for detecting anomalous ejection based on a residual vibration signal from the head unit.

Heretofore, an amplifier circuit for amplifying a voltage generated due to residual vibration of an actuator has been incorporated in a head driver IC. A high voltage of several tens of volts is needed to drive an actuator, for example, and therefore the head driver IC is manufactured using a high voltage process. As a result, the amplifier circuit is also manufactured using the high voltage process, and there is a problem in that the layout area substantially increases.

SUMMARY

One aspect of the present disclosure relates to an integrated circuit device including: a first terminal to be connected to a driving signal line of a driving circuit that drives an actuator of a nozzle that discharges a liquid droplet by causing the actuator to displace a vibrating plate; a first switch circuit whose one end is connected to the first terminal; an amplifier circuit that receives an output signal from another end of the first switch circuit, and amplifies an induced voltage of the actuator generated due to residual vibration of the vibrating plate after the actuator having been driven; a voltage boosting circuit that generates a boosted voltage for level-shifting a switching signal of the first switch circuit based on a step-up clock signal; and a control circuit that controls the voltage boosting circuit and the first switch circuit.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

The following is a detailed description of preferred embodiments of the present disclosure, Note that the embodiments described below are not intended to unduly limit the content of the invention recited in the claims, and all of the configurations described in the embodiments are not necessarily essential as solutions provided by the present disclosure.

1. Detection Method of Anomalous Nozzle

A method for detecting an anomalous nozzle based on residual vibration of an actuator will be described using FIGS. 1 and 2.

Figure 1:
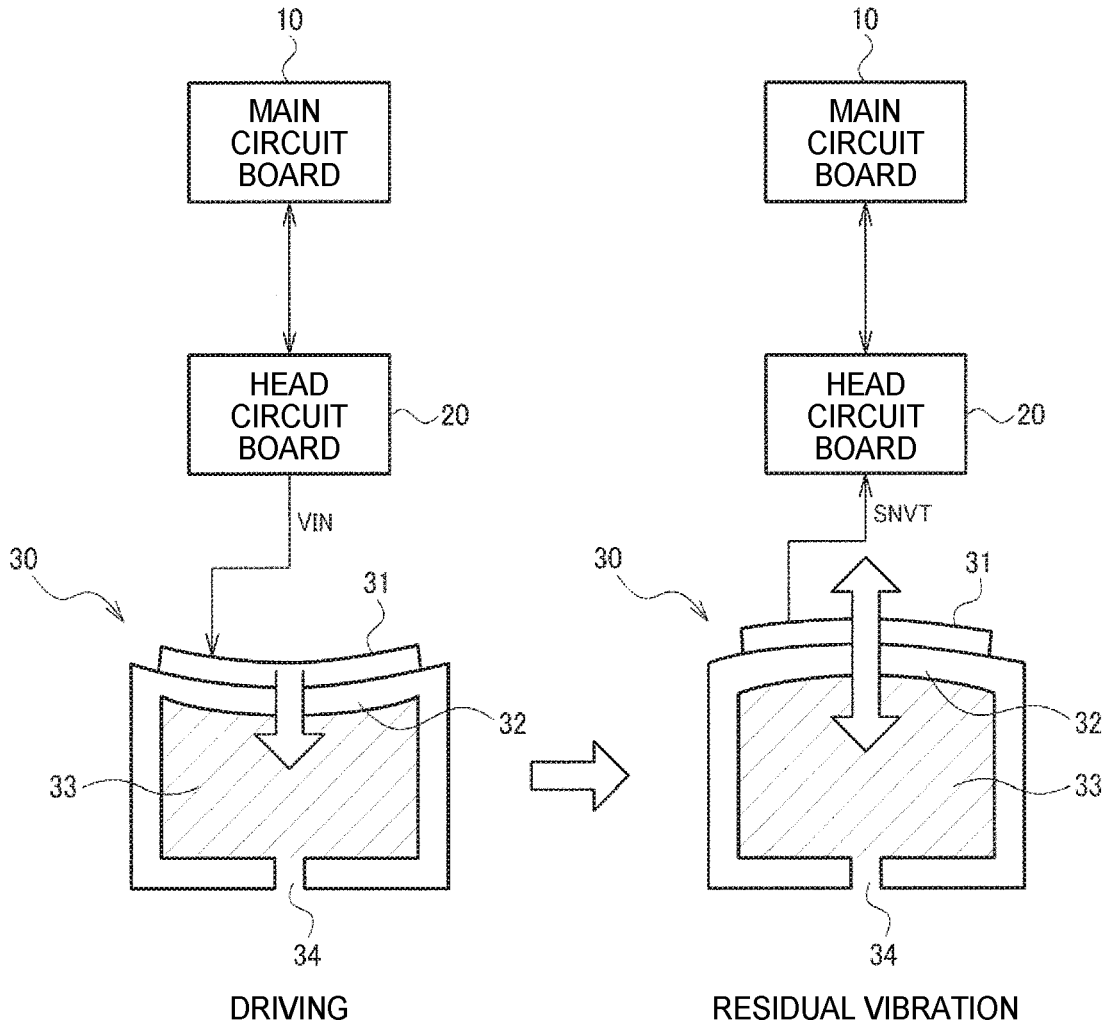
FIG. 1 is a diagram illustrating a method for detecting an anomalous nozzle.

FIG. 1 shows an outline of a printing system in an inkjet printer. A main circuit board 10 is installed in a printer main body, and transmits print data and a timing control signal to a head circuit board 20. The head circuit board 20 drives a nozzle 30 of a head unit based on the print data and the timing control signal. The nozzle 30 includes a vibrating plate 32 and an actuator 31 that causes the vibrating plate 32 to vibrate. The actuator 31 is a piezo element, an electrostatic actuator, or the like, and is provided in contact with the vibrating plate 32. As a result of applying a drive voltage VIN from the head circuit board 20 to the actuator 31, the actuator 31 deforms. The vibrating plate 32 deforms due to this deformation, and as a result, ink in a cavity 33 is discharged from an ejection port 34.

Since the vibrating plate 32 deforms when the actuator 31 is driven by the drive voltage VIN, the vibrating plate 32 vibrates due to reaction after the actuator 31 having been driven. Such vibration occurring after being driven is referred to as residual vibration. Due to this residual vibration, an induced voltage SNVT is generated in the actuator 31. The induced voltage SNVT is input to the head circuit board 20. Note that, as will be described later, a detection period for detecting an anomalous nozzle is provided separately from a period in which normal printing operation is performed, and driving for causing the residual vibration to occur is performed in this detection period.

Figure 2:
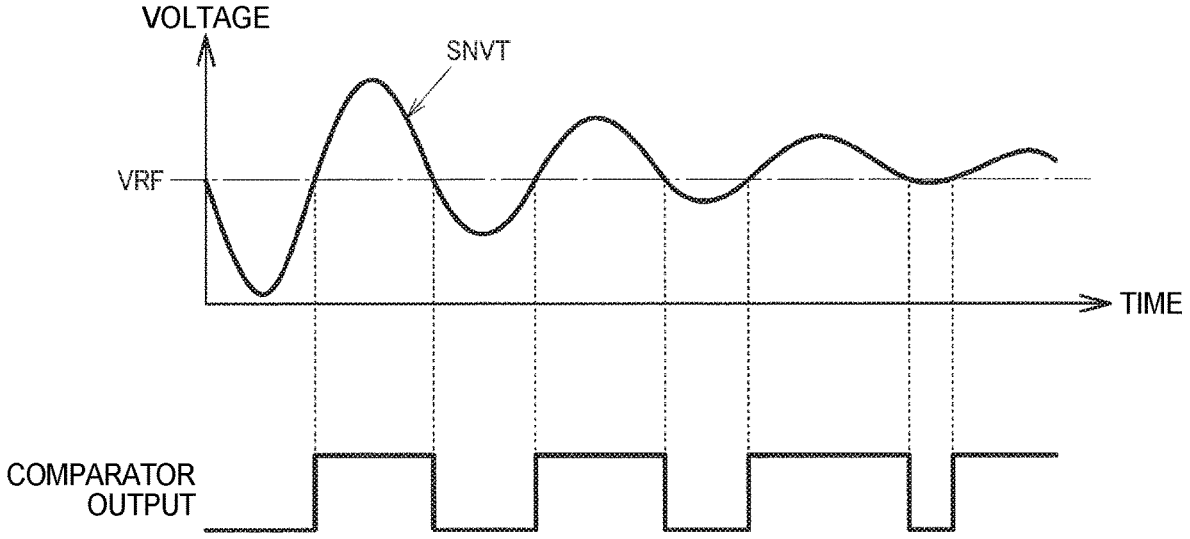
FIG. 2 is a diagram illustrating a method for detecting an anomalous nozzle.

FIG. 2 shows an exemplary waveform of the induced voltage SNVT due to residual vibration, and an exemplary waveform obtained by binarizing the waveform. The induced voltage SNVT changes as the vibrating plate 32 vibrates, and therefore takes an oscillating waveform. The cycle of the oscillating waveform is the same as the cycle of the residual vibration. Also, the amplitude of the oscillating waveform decreases as the residual vibration is attenuated. The induced voltage SNVT is compared with a reference voltage VRF by a comparator, and is binarized. For example, in a period in which SNVT>VRF, the comparator output is at a high level, and in a period in which SNVT<VRF, the comparator output is at a low level.

When an anomaly occurs in the nozzle, the cycle or the amplitude of the residual vibration changes. For example, when bubbles have been mixed in ink in the cavity 33, the cycle of the residual vibration decreases. Alternatively, when the viscosity of ink in the cavity 33 has increased, the cycle of the residual vibration increases. Alternatively, when a foreign matter has attached to an ejection port of the nozzle 30, the amplitude of the residual vibration decreases. A host device such as an SOC (System On Chip) are mounted on the main circuit board 10, and its control device detects the above-described changes based on the comparator output, and as a result an anomalous nozzle is determined.

Note that, in FIG. 2, the reference voltage VRF is set at the center of the oscillating waveform, but there is no limitation thereto, and the reference voltage VRF may be set at any voltage. The amplitude and the frequency thereof can be detected by setting the reference voltage VRF at a voltage other than the central voltage of the oscillating waveform, for example. Also, a plurality of reference voltages may be set, and an anomalous nozzle may be detected based on comparator outputs corresponding to the respective reference voltages.

2. Known Example

Figure 3:
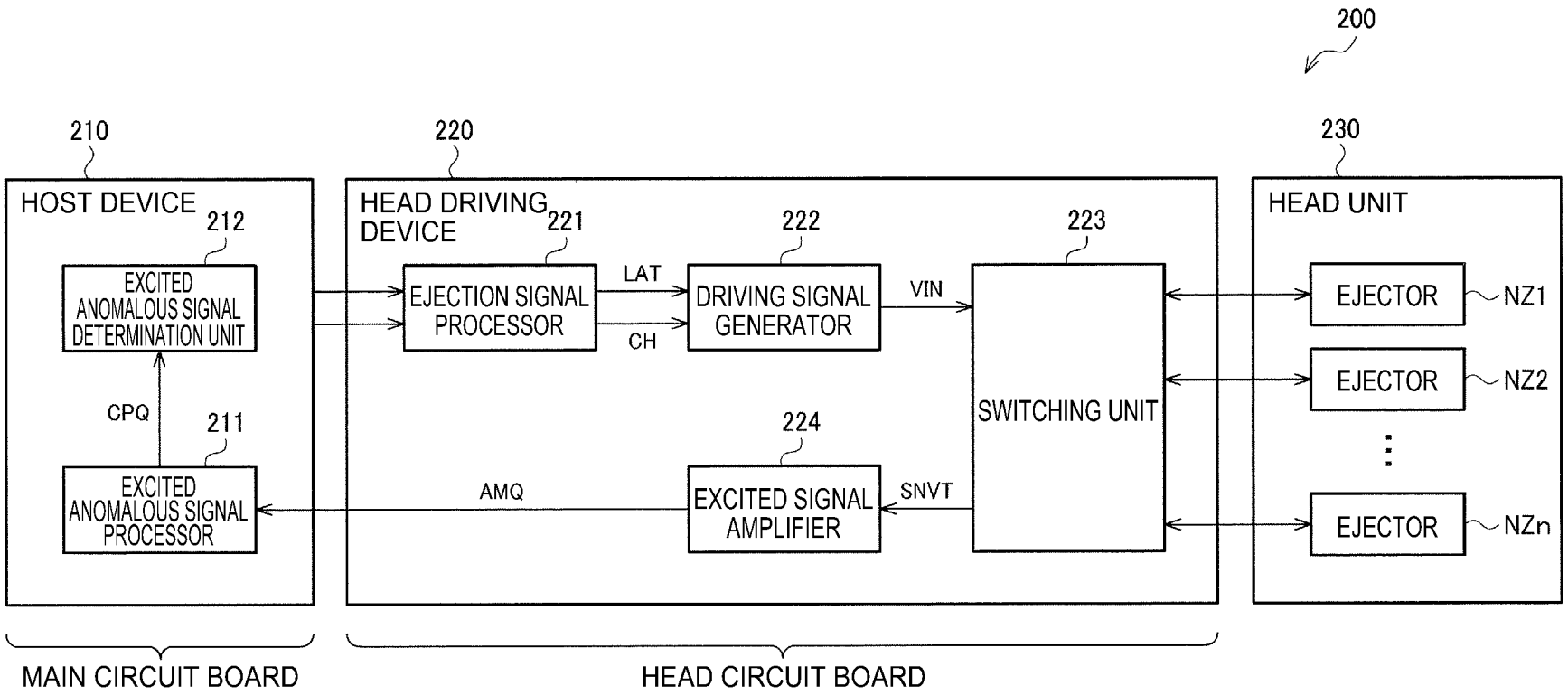
FIG. 3 RELATED ART
FIG. 3 is an exemplary configuration of a known liquid droplet ejection device.

First, an exemplary configuration of a known liquid droplet ejection device 200 will be described, and problems in the known example will be described. FIG. 3 shows an exemplary configuration of a known liquid droplet ejection device 200. The liquid droplet ejection device 200 includes a host device 210, a head driving device 220, and a head unit 230.

The host device 210 is mounted on a main circuit board that is installed in a main body of the liquid droplet ejection device 200, and is an SOC, a CPU, a microcomputer, or the like. Note that the host device 210 may be realized by a plurality of ICs and discrete components that are mounted on the main circuit board 10. The host device 210 is a control device for controlling the units of the liquid droplet ejection device. For example, the host device 210 controls a paper feed operation, movement of a head, and driving of the head, in printing. The host device 210 includes an excited anomalous signal processor 211 and an excited anomalous signal determination unit 212.

The head is provided such that the head can move relative to the main body of the liquid droplet ejection device 200, and a head circuit board and a head unit 230 are provided in the head. The head driving device 220 is mounted on the head circuit board, drives the head unit 230, and amplifies an induced voltage generated due to residual vibration. The head driving device 220 is a head driver IC. The head driving device 220 includes an ejection signal processor 221, a driving signal generator 222, a switching unit 223, and an excited signal amplifier 224.

The head unit 230 includes ejectors NZ1 to NZn that eject liquid droplets based on driving signals from the head driving device 220. n is an integer of two or more. When the liquid droplet ejection device 200 is an ink-jet printer, the liquid droplet is ink. The ejectors NZ1 to NZn each correspond to the nozzle 30 in FIG. 1, and include the vibrating plate and the actuator.

Next, the operations of the liquid droplet ejection device 200 when normal printing is performed will be described. The host device 210 outputs print data and a driving control signal to the ejection signal processor 221.

The ejection signal processor 221 generates control signals LAT and CH for controlling the driving timing of the ejectors NZ1 to NZn based on the driving control signal. Also, the ejection signal processor 221 outputs first to nth pieces of print data respectively corresponding to the ejectors NZ1 to NZn. The ejection signal processor 221 is constituted by a logic circuit, for example.

The driving signal generator 222 outputs drive voltages VIN1 to VINn based on the control signals LAT and CH and the first to nth pieces of print data. The drive voltage VINi has a voltage waveform designated by $i^{th}$ piece of print data. i is an integer of one or more and n or less. Note that, VIN1 to VINn are collectively denoted by VIN in FIG. 3.

Here, the control signal LAT is a signal for latching the first to nth pieces of print data. Also, the control signal CH is a signal for sequentially selecting bits in the $i^{th}$ print data. Specifically, the driving signal generator 222 includes latch circuits for latching first to nth pieces of print data based on the control signal LAT, and decoders for converting the first to nth pieces of print data from the latch circuits to the drive voltages VIN1 to VINn. The decoder sequentially outputs voltage waveforms respectively corresponding to the bits in the $i^{th}$ print data. For example, assume that the $i^{th}$ print data is constituted by first to third bits. In this case, the decoder outputs, in time series, a first voltage waveform corresponding to the first bit, a second voltage waveform corresponding to the second bit, and a third voltage waveform corresponding to the third bit as the drive voltage VINi.

The switching unit 223 is a switch circuit for switching connections between the driving signal generator 222, the ejectors NZ1 to NZn, and the excited signal amplifier 224. When printing is performed, the switching unit 223 inputs the drive voltage VINi from the driving signal generator 222 to the ejector NZi. The actuator of the ejector NZi causes the nozzle to eject ink by moving the vibrating plate based on the voltage waveform of the drive voltage VINi.

Next, the operations of the liquid droplet ejection device 200 when detecting an anomalous nozzle will be described. When detecting an anomalous nozzle, whether or not an anomaly occurs is sequentially detected with respect to the ejectors NZ1 to NZn one by one.

First, the driving signal generator 222 outputs the drive voltage VIN1. The method of generating the drive voltage VIN1 is basically the same as that when printing is performed. The switching unit 223 inputs the drive voltage VIN1 from the driving signal generator 222 to the ejector NZ1.

Next, the switching unit 223 inputs the induced voltage SNVT generated due to residual vibration of the ejector NZ1 to the excited signal amplifier 224. The excited signal amplifier 224 performs analog signal processing such as amplification processing on the induced voltage SNVT, and outputs an analog signal AMQ subjected to the processing.

The excited anomalous signal processor 211 of the host device 210 converts the analog signal AMQ to a digital comparison result signal CPQ by comparing the analog signal AMQ and the reference voltage VRF using a comparator. The excited anomalous signal determination unit 212 determines whether the nozzle of the ejector NZ1 is in a normal state or in an anomalous state based on the comparison result signal CPQ.

Similar anomalous nozzle detection is sequentially performed with respect to ejectors NZ2 to NZn. With this, it is determined whether the nozzle is in a normal state or in an anomalous state with respect to each of the ejectors NZ1 to NZn.

In a known example described above, the excited signal amplifier 224 that amplifies the induced voltage SNVT generated due to residual vibration is incorporated in the head driver IC. Because the head driver IC needs to drive the actuators of the nozzle, the head driver IC is manufactured using a high voltage process of approximately 40 V. Therefore, the amplifier circuit of the excited signal amplifier 224 is constituted by transistors that are manufactured using the high voltage process, and the layout area substantially increases. However, the high voltage process need not necessarily be used in order to detect the induced voltage SNVT generated due to residual vibration.

Also, in the known example, the analog signal AMQ, which is a signal obtained by amplifying the induced voltage SNVT is transmitted from the head driving device 220 to the host device 210. Since the head is configured such that the head can move relative to the main body, the head circuit board installed in the head and the main circuit board installed in the main body is coupled by a flexible board or the like. The analog signal AMQ is transmitted by wiring in the flexible board, and therefore is susceptible to external noise. For example, the analog signal AMQ is influenced by noise generated when a mechanical operation such as head movement is performed. When noise is mixed in the analog signal AMQ, the accuracy in detecting an anomalous nozzle may decrease.

3. Exemplary Configuration of Present Embodiment

Figure 4:
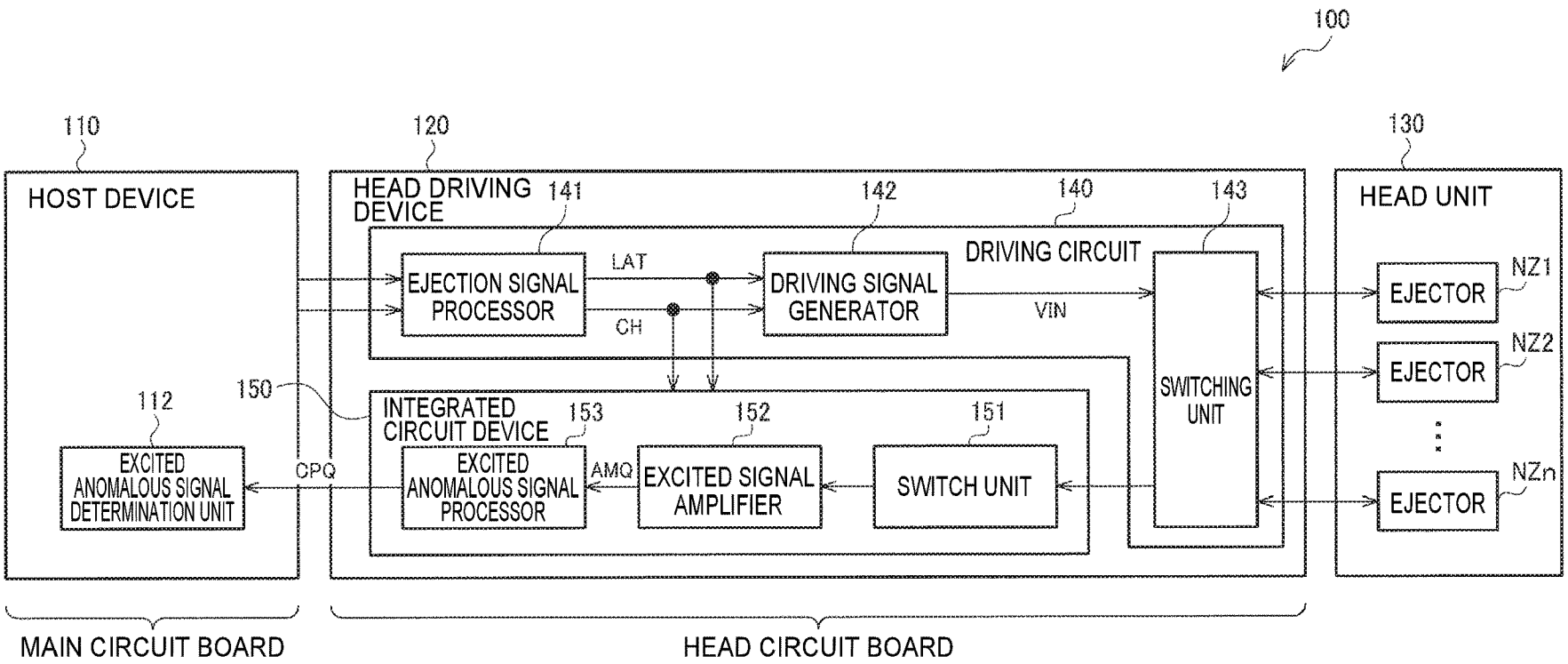
FIG. 4 is an exemplary configuration of a liquid droplet ejection device of a present embodiment.

FIG. 4 shows an exemplary configuration of a liquid droplet ejection device 100 of the present embodiment that can solve the problems described above. The liquid droplet ejection device 100 includes a host device 110, a head driving device 120, and a head unit 130. Note that, in the following, constituent elements corresponding to those in FIG. 3 will be given descriptions with respect to the correspondence, and the descriptions thereof will be omitted as appropriate.

The host device 110 corresponds to the host device 210 in FIG. 3. However, the host device 110 includes an excited anomalous signal determination unit 112, but does not include the excited anomalous signal processor.

The head driving device 120 includes a driving circuit 140 and an integrated circuit device 150. The driving circuit 140 is a head driver IC, and the integrated circuit device 150 is provided separately from the head driver IC. The driving circuit 140 and the integrated circuit device 150 are mounted on the head circuit board. The driving circuit 140 drives the head unit 130. The integrated circuit device 150 amplifies an induced voltage generated due to residual vibration, and converts the amplified signal to a digital signal. The driving circuit 140 includes an ejection signal processor 141, a driving signal generator 142, and a switching unit 143. The integrated circuit device 150 includes a switch unit 151, an excited signal amplifier 152, and an excited anomalous signal processor 153. The ejection signal processor 141 corresponds to the ejection signal processor 221 in FIG. 3, and the driving signal generator 142 corresponds to the driving signal generator 222 in FIG. 3. The switching unit 143 and the switch unit 151 correspond to the switching unit 223 in FIG. 3. The excited signal amplifier 152 corresponds to the excited signal amplifier 224 in FIG. 3, and the excited anomalous signal processor 153 corresponds to the excited anomalous signal processor 211 in FIG. 3.

Next, the operations of the liquid droplet ejection device 100 will be described. The operations when normal printing is performed are the same as those in FIG. 3, and therefore the description thereof will be omitted. Hereinafter, the operations of the liquid droplet ejection device 100 when detecting an anomalous nozzle will be described.

The host device 110 outputs a driving control signal in a detection mode to the ejection signal processor 141. Note that the detection mode is a mode in the integrated circuit device 150. The driving circuit 140 does not recognize the detection mode, and merely operates based on control signals LAT and CH from the host device 110.

The ejection signal processor 141 generates the control signals LAT and CH for controlling driving timings of the ejectors NZ1 to NZn in the detection mode based on the driving control signal.

The driving signal generator 142 outputs a drive voltage VIN1 in the detection mode based on the control signals LAT and CH.

The switching unit 143 inputs the drive voltage VIN1 from the driving signal generator 142 to the ejector NZ1. Next, the switching unit 143 inputs an induced voltage SNVT, from the ejector NZ1, that is generated due to residual vibration to the integrated circuit device 150.

The integrated circuit device 150 recognizes the detection mode based on the signal waveforms of the control signals LAT and CH. The integrated circuit device 150 detects the induced voltage SNVT in a detection period specified by the control signals LAT and CH.

Specifically, in the detection mode, the switch unit 151 inputs the induced voltage SNVT to the excited signal amplifier 152. The excited signal amplifier 152 performs analog signal processing such as amplification processing on the induced voltage SNVT, and outputs an analog signal AMQ subjected to the processing. The excited anomalous signal processor 153 converts the analog signal AMQ to a digital comparison result signal CPQ by comparing the analog signal AMQ with the reference voltage VRF using a comparator.

The excited anomalous signal determination unit 112 of the host device 110 determines whether the nozzle of the ejector NZ1 is in a normal state or in an anomalous state based on the comparison result signal CPQ.

Similar anomalous nozzle detection is sequentially performed with respect to ejectors NZ2 to NZn. With this, it is determined whether the nozzle is in a normal state or in an anomalous state with respect to each of the ejectors NZ1 to NZn.

As described above, in the present embodiment, the switch unit 151 that acquires the induced voltage SNVT, the excited signal amplifier 152 that amplifies the induced voltage SNVT, and the excited anomalous signal processor 153 that converts the amplified analog signal AMQ into the digital comparison result signal CPQ are integrated into one chip as the integrated circuit device 150.

In the present embodiment described above, the excited signal amplifier 152 that amplifies the induced voltage SNVT generated due to residual vibration is included in the integrated circuit device 150 that is separated from the head driver IC. Therefore, the amplifier circuit in the excited signal amplifier 152 can be formed using a low voltage process, the breakdown voltage thereof being lower than that of the process used for the head driver IC, and therefore the layout area thereof can be reduced relative to the case where the excited signal amplifier 152 is incorporated in the head driver IC.

Also, in the present embodiment, the excited anomalous signal processor 153 is integrated in the integrated circuit device 150. With this, the excited anomalous signal processor 153 can be provided in the head circuit board instead of the main circuit board that is installed in the main body. That is, the comparison result signal CPQ, which is a digital signal, is transmitted from the head circuit board to the main circuit board, Since an analog signal no longer need to be transmitted using a flexible board or the like, the immunity to external noise can be improved. With this, the accuracy in detecting an anomalous nozzle can be improved.

Also, in the present embodiment, the switch unit 151 is integrated in the integrated circuit device 150, and therefore the integrated circuit device 150 can acquire the induced voltage SNVT when detecting an anomalous nozzle.

Note that the switch unit 151 includes a switch circuit constituted by transistors. These transistors handle the induced voltage SNVT, and therefore a voltage higher than the power supply voltage of the excited signal amplifier 152 needs to be supplied thereto, Therefore, as will be described later, the integrated circuit device 150 includes a voltage boosting circuit. The voltage boosting circuit is a charge pump circuit, for example. The operation clock signal of the voltage boosting circuit may be a noise source to the excited signal amplifier 152 and the excited anomalous signal processor 153. In the present embodiment, the operation clock signal of the voltage boosting circuit is suspended in the detection period in order to avoid this problem. The details thereof will be described later,

4. Detailed Exemplary Configuration

Figure 5:
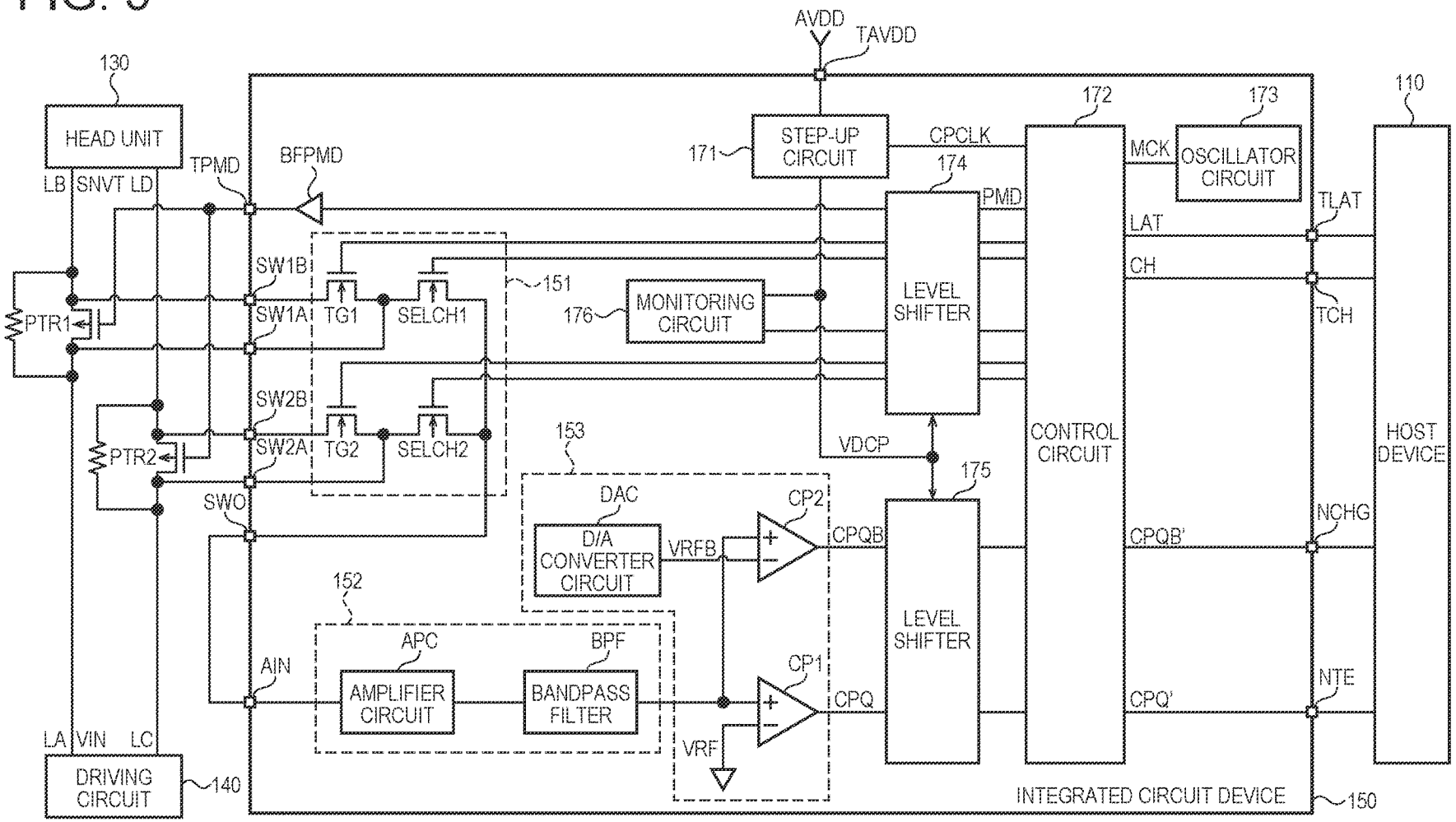
FIG. 5 is a detailed exemplary configuration of an integrated circuit device.

FIG. 5 shows a detailed exemplary configuration of the integrated circuit device 150. The integrated circuit device 150 includes the switch unit 151, the excited signal amplifier 152, the excited anomalous signal processor 153, a buffer circuit BFPMD, a voltage boosting circuit 171, a control circuit 172, an oscillator circuit 173, level shifters 174 and 175, and a monitoring circuit 176. Also, the integrated circuit device 150 includes control signal input terminals TLAT and TCH, output terminals NCHG and NTE, and terminals TAVDD, TPMD, SW1A, SW1B, SW2A, SW2B, SWO, and AIN. Note that the excited signal amplifier 152 and the excited anomalous signal processor 153 may also be referred to as an analog front end circuit. Also, the terminals SW1A, SW1B, SW2A, and SW2B may also be respectively referred to as a first terminal, a second terminal, a third terminal, and a fourth terminal.

The integrated circuit device 150 has a first channel and a second channel as channels for detecting an anomalous nozzle. A transistor PTR1 corresponding to the first channel and a transistor PTR2 corresponding to the second channel are provided on the head circuit board, which is external to the integrated circuit device 150. The transistors PTR1 and PTR2 are P-type transistors.

A drain of the transistor PTR1 is connected to the terminal SW1A and a driving signal line LA of the driving circuit 140. The driving signal line LA is a signal line to which the drive voltage VIN is output when the first channel is used. Also, a source of the transistor PTR1 is connected to the terminal SW1B, and is connected to the head unit 130 through an actuator-side driving signal line LB. Note that, although the illustration is omitted in FIG. 5, the actuator-side driving signal line LB is connected to one of the actuators of the ejectors NZ1 to NZn via the switching unit 143.

A drain of the transistor PTR2 is connected to the terminal SW2A and a driving signal line LC of the driving circuit 140. The driving signal line LC is a signal line to which the drive voltage VIN is output when the second channel is used. Also, a source of the transistor PTR2 is connected to the terminal SW2B, and is connected to the head unit 130 through an actuator-side driving signal line LD. Note that, although the illustration is omitted in FIG. 5, the actuator-side driving signal line LD is connected to one of the actuators of the ejectors NZ1 to NZn via the switching unit 143.

The voltage boosting circuit 171 steps up a power supply voltage AVDD supplied to the terminal TAVDD from the outside of the integrated circuit device 150 to a boosted voltage VDCP. The voltage boosting circuit 171 generates the boosted voltage VDCP by performing a switching operation based on a step-up clock signal CPLCK that is input from the control circuit 172. The voltage boosting circuit 171 is a charge pump circuit, for example. The charge pump circuit is constituted by a switch circuit constituted by a transistor and a capacitor. Note that the capacitor may be provided outside the integrated circuit device 150. In this case, the switch circuit is incorporated in the integrated circuit device 150 as the voltage boosting circuit 171.

The monitoring circuit 176 monitors the boosted voltage VDCP. Specifically, the monitoring circuit 176 compares the boosted voltage VDCP with a threshold voltage, and outputs the comparison result as a monitoring result signal. Note that the monitoring circuit 176 may be omitted. For example, as will be described in FIG. 8, the period in which the step-up clock signal CPLCK is suspended may be fixed. In this case, the monitoring circuit 176 may be omitted.

The level shifter 174 level-shifts the signal level of a signal output from the control circuit 172 to a signal level of a circuit that operates with the boosted voltage VDCP. The control circuit 172 operates with a logic power supply whose voltage level is lower than the power supply voltage AVDD, for example. On the other hand, the buffer circuit BFPMD and the switch unit 151 operate with the boosted voltage VDCP. That is, the level shifter 174 level-shifts a signal at a voltage level of the logic power supply to a signal at a voltage level of the boosted voltage VDCP. Also, the level shifter 174 level-shifts the signal level of a circuit that operates with the boosted voltage VDCP to the signal level of a signal output from the control circuit 172, The monitoring circuit 176 operates with the boosted voltage VDCP, That is, the level shifter 174 level-shifts the monitoring result signal from the monitoring circuit 176 to a signal at a voltage level of the logic power supply.

The level shifter 175 level-shifts the signal level of a signal output from the excited anomalous signal processor 153 to a signal level of the control circuit 172 that operates with the logic power supply. The excited signal amplifier 152 and the excited anomalous signal processor 153 operate with the power supply voltage AVDD. That is, the level shifter 75 level-shifts a signal at a voltage level of the power supply voltage AVDD to a signal at a voltage level of the logic power supply.

The switch unit 151 includes switch circuits SELCH1, TG1, SELCH2, and TG2. Note that the switch circuits SELCH1, TG1, SELCH2, and TG2 may also respectively referred to as a first switch circuit, a second switch circuit, a third switch circuit, and a fourth switch circuit.

The switch circuits SELCH1, TG1, SELCH2, and TG2 are N-type transistors, for example. However, there is no limitation thereto, and the switch circuits SELCH1, TG1, SELCH2, and TG2 may be transfer gates, for example.

One end of the switch circuit SELCH1 is connected to the terminal SW1A, and the other end is connected to the terminal SWO. One end of the switch circuit TG1 is connected to the terminal SW1B and the other end is connected to the terminal SW1A. One end of the switch circuit SELCH2 is connected to the terminal SW2A and the other end is connected to the terminal SWO. One end of the switch circuit TG2 is connected to the terminal SW2B, and the other end is connected to the terminal SW2A.

As will be described later, as a result of controlling ON and OFF of these switch circuits, the induced voltage SNVT is output from the terminal SWO in the detection period. The terminal SWO is connected to the terminal AIN with wiring outside the integrated circuit device 150. The induced voltage SNVT output from the terminal SWO is input to the amplifier circuit APC through the terminal AIN.

The excited signal amplifier 152 includes an amplifier circuit APC that amplifies the induced voltage SNVT input from the terminal AIN, and a bandpass filter BPF that performs bandpass filtering processing on an output voltage of the amplifier circuit APC. Note that the excited signal amplifier 152 may include a low-pass filter or the like instead of the bandpass filter BPF. That is, the excited signal amplifier 152 need only include a filter provided downstream of the amplifier circuit APC.

The amplifier circuit APC includes an amplifier circuit that amplifies the induced voltage SNVT input from the terminal AIN, and a programmable gain amplifier that amplifies an output voltage of the amplifier circuit with a gain that can be variably set, for example. The programmable gain amplifier outputs the amplified output voltage to the bandpass filter BPF.

The frequency band of the bandpass filter BPF does not include the frequency of the step-up clock signal CPLCK. That is, as a result of a signal passing through the bandpass filter BPF, noise caused by the step-up clock signal CPLCK can be reduced from the signal. The bandpass filter BPF includes an amplifier circuit, and a resistor and a capacitor that constitute a feedback circuit. Note that the feedback circuit may be provided outside the integrated circuit device 150. In this case, the portion of the amplifier circuit is incorporated in the integrated circuit device 150 as the bandpass filter BPF The excited anomalous signal processor 153 includes comparators CP1 and CP2 and a D/A converter circuit DAC.

The comparator CP1 compares the output voltage of the bandpass filter BPF with the reference voltage VRF, and outputs the comparison result signal CPQ. The reference voltage VRF is generated by voltage-division using resistors, for example.

The D/A converter circuit DAC generates a reference voltage VRFB by DIA converting setting data. The reference voltage VRFB can be variably set by changing the setting data. For example, the host device 110 transmits the setting data to the integrated circuit device 150.

The comparator CP2 compares the output voltage of the bandpass filter BPF with the reference voltage VRFB, and outputs a comparison result signal CPQB.

The level shifter 175 level-shifts the comparison result signals CPQ and CPQB, and outputs the level-shifted signals to the control circuit 172.

Note that, in FIG. 5, the excited anomalous signal processor 153 includes two comparators, but there is no limitation thereto, and the excited anomalous signal processor 153 may include one comparator or three or more comparators. For example, one more set of a D/A converter circuit and a comparator may be added, in FIG. 5.

The oscillator circuit 173 generates a clock signal MCK by oscillation, and outputs the clock signal MCK to the control circuit 172.

Here, the control circuit 172 generates the step-up clock signal CPLCK by dividing the clock signal MCK, and outputs the step-up clock signal CPLCK to the voltage boosting circuit 171. Also, the control circuit 172 controls the units of the integrated circuit device 150.

Specifically, the control signal LAT is input from the host device 110 to the control circuit 172 through the control signal input terminal TLAT. Also, the control signal CH is input from the host device 110 to the control circuit 172 through the control signal input terminal TCH. The control circuit 172 outputs a gate driving signal PMD for controlling ON and OFF of the transistors PTR1 and PTR2 based on the control signals LAT and CH. The level shifter 174 level-shifts the gate driving signal PMD, and the buffer circuit BFPMD buffers the level-shifted gate driving signal PMD. The buffer circuit BFPMD drives the transistors PTR1 and PTR2 by outputting the buffered signal to the gates of the transistors PTR1 and PTR2 through the terminal TPMD.

Also, the control circuit 172 outputs first to fourth switching signals for controlling ON and OFF of the switch circuits SELCH1, TG1, SELCH2, and TG2 based on the control signals LAT and CH. The level shifter 174 level-shifts the first to fourth switching signals. The switch circuit SELCH1 is controlled to be turned on or off by the level-shifted first switching signal. The switch circuit TG1 is controlled to be turned on or off by the level-shifted second switching signal. The switch circuit SELCH2 is controlled to be turned on or off by the level-shifted third switching signal. The switch circuit TG2 is controlled to be turned on or off by the level-shifted fourth switching signal.

Also, the control circuit 172 outputs comparison result signals CPQ' and CPQB' to the host device 110, in the detection period. That is, the level shifter 175 level-shifts the comparison result signal CPQ from the comparator CP1. The control circuit 172 outputs the level-shifted comparison result signal CPQ to the host device 110 as the comparison result signal CPQ' from the output terminal NTE. Also, the level shifter 175 level-shifts the comparison result signal CPQB from the comparator CP2. The control circuit 172 outputs the level-shifted comparison result signal CPQB to the host device 110 as the comparison result signal CPQB' from the output terminal NCHG.

Also, the control circuit 172 recognizes the detection period of the induced voltage SNVT based on the control signals LAT and CH. The control circuit 172 suspends the output of the step-up clock signal CPLCK in the detection period of the induced voltage SNVT. That is, the switching operation of the voltage boosting circuit 171 stops in the detection period.

In the present embodiment described above, the integrated circuit device 150 includes the terminal SW1A, the switch circuit SELCH1, the amplifier circuit APC, the voltage boosting circuit 171, and the control circuit 172. The terminal SW1A is connected to the driving signal line LA of the driving circuit 140 that drives an actuator of the liquid droplet ejection head. The liquid droplet ejection head includes a nozzle that discharges a liquid droplet by displacing the vibrating plate using the actuator. One end of the switch circuit SELCH1 is connected to the terminal SW1A. The amplifier circuit APC receives an output signal from the other end of the switch circuit SELCH1, and amplifies the induced voltage SNVT of the actuator generated due to residual vibration of the vibrating plate after the actuator was driven. The voltage boosting circuit 171 generates the boosted voltage VDCP for level-shifting the switching signal of the switch circuit SELCH1 based on the step-up clock signal CPLCK. The control circuit 172 controls the voltage boosting circuit 171 and the switch circuit SELCH1.

According to the present embodiment, the integrated circuit device 150 including the amplifier circuit APC is configured as an IC separated from the driving circuit 140. With this, the amplifier circuit APC can be formed using a low voltage process that is different from the high voltage process for the driving circuit 140. Also, according to the present embodiment, as a result of providing the switch circuit SELCH1 and the voltage boosting circuit 171, the integrated circuit device 150 can acquire the induced voltage SNVT from the actuator. That is, as a result of the switch circuit SELCH1 being turned on, the induced voltage SNVT is input to the amplifier circuit APC.

However, because the voltage boosting circuit 171 is provided in order to operate the switch circuit SELCH1, the switching noise of the voltage boosting circuit 171 may affect the anomalous nozzle detection. As described above, the bandpass filter BPF for reducing noise from the voltage boosting circuit 171 is provided downstream of the amplifier circuit APC. However, it is difficult to completely remove the influence of noise.

In this regard, in the present embodiment, the control circuit 172 stops outputting of the step-up clock signal CPLCK in the detection period of the induced voltage SNVT.

In this way, outputting of the step-up clock signal CPLCK and the switching operation of the voltage boosting circuit 171 are suspended in the detection period for detecting the induced voltage SNVT. With this, the influence of noise can be removed when the anomalous nozzle detection is performed, and accurate anomalous nozzle detection can be performed.

Note that, the frequency of the step-up clock signal CPLCK may be changed in the detection period instead of stopping the step-up clock signal CPLCK in the detection period, That is, the control circuit 172 may output the step-up clock signal CPLCK with a first frequency in the driving period of the actuator, and output the step-up clock signal CPLCK with a second frequency that is different from the first frequency in the detection period.

Figure 6:
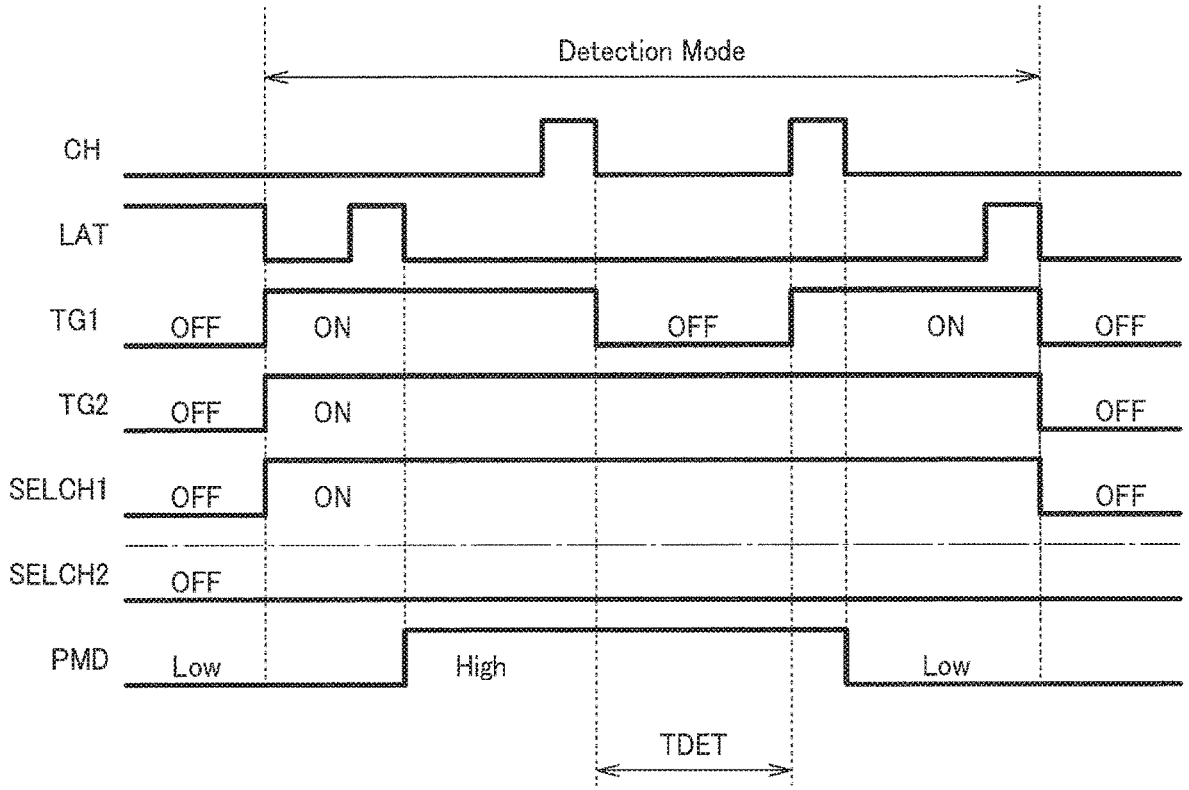
FIG. 6 is a timing chart for illustrating operations of the integrated circuit device.

FIG. 6 is a timing chart for illustrating the operations of the integrated circuit device 150. A case where the first channel is used will be described in FIG. 6, as an example.

The control circuit 172 transitions to a detection mode when detecting, in a predetermined mode, falling of the control signal LAT. When transitioned to the detection mode, the control circuit 172 turns on the switch circuits TG1, TG2, and SELCH1. The switch circuit SELCH2 remains off. Note that the predetermined mode is a communication mode, for example, and the control circuit 172 transitions to the communication mode upon detecting specific waveforms of the control signals LAT and CH.

In the detection mode, when the control signal LAT first rises then falls, the control circuit 172 changes the level of the gate driving signal PMD from a low level to a high level. That is, the control circuit 172 turns off the transistor PTR1.

Next, the control circuit 172 recognizes the period from when the control signal CH has fallen after the control signal CH rose until when the control signal CH rises next as the detection period TDET. The control circuit 172 turns off the switch circuit TG1 from the start of the detection period TDET to the end thereof. When the detection period TDET has ended, the control circuit 172 turns on the switch circuit TG1.

Next, when the control signal CH falls after the detection period TDET has ended, the control circuit 172 changes the level of the gate driving signal PMD from a high level to a low level. That is, the control circuit 172 turns on the transistor PTR1. When the detection mode has ended, the control circuit 172 turns off the switch circuits TG1, TG2, and SELCH1.

Note that, when the second channel is used, the operations of the switch circuit TG1 and the operations of the switch circuit TG2 are switched, and the operations of the switch circuit SELCH1 and the operations of the switch circuit SELCH2 are switched.

A case where one detection period is provided in the detection mode is illustrated in FIG. 6, but the detection period may be repeated a plurality of times in the detection mode. In this case, the waveforms, in FIG. 6, in the detection period indicated by the two-way arrow denoted as TDET are repeated a plurality of times.

Figure 7:
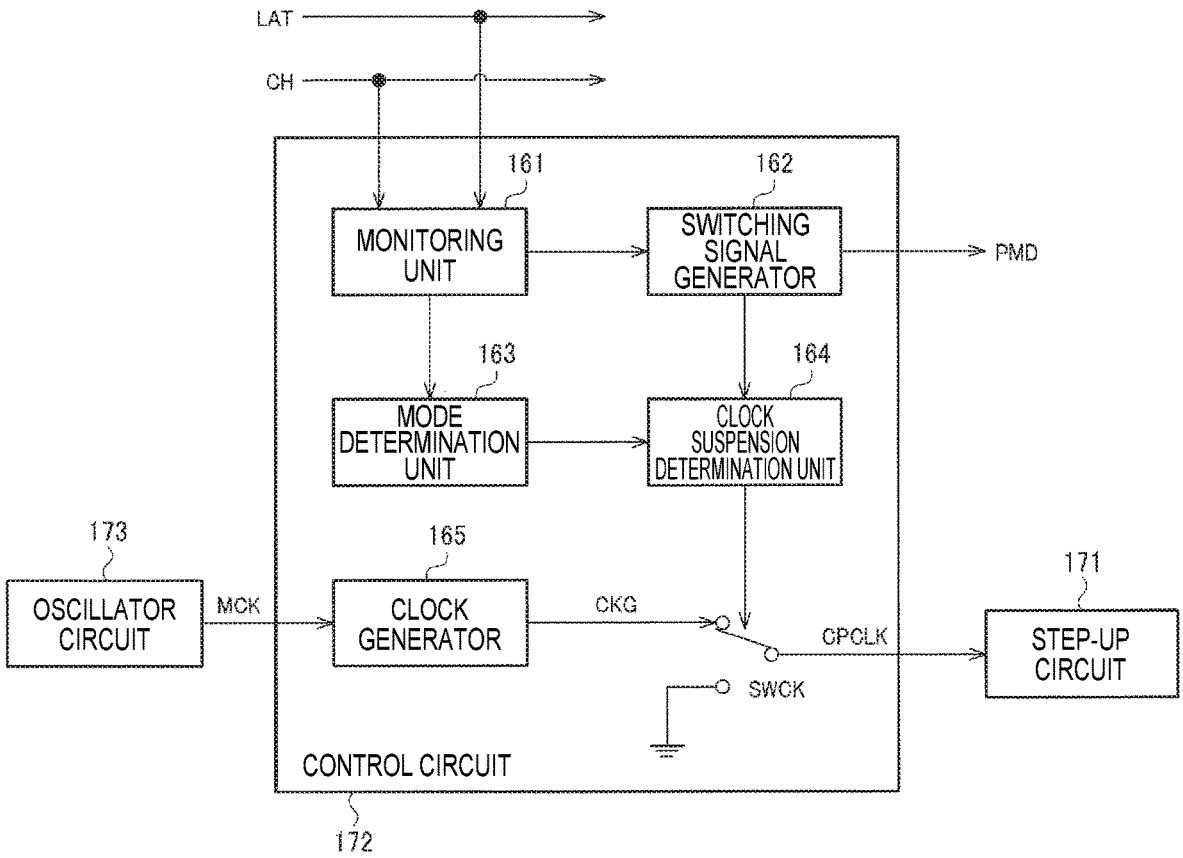
FIG. 7 is a detailed exemplary configuration of a control circuit.

FIG. 7 shows a detailed exemplary configuration of the control circuit 172. The control circuit 172 includes a monitoring unit 161, a switching signal generator 162, a mode determination unit 163, a clock suspension determination unit 164, a clock generator 165, and a selector SWCK.

Figure 8:
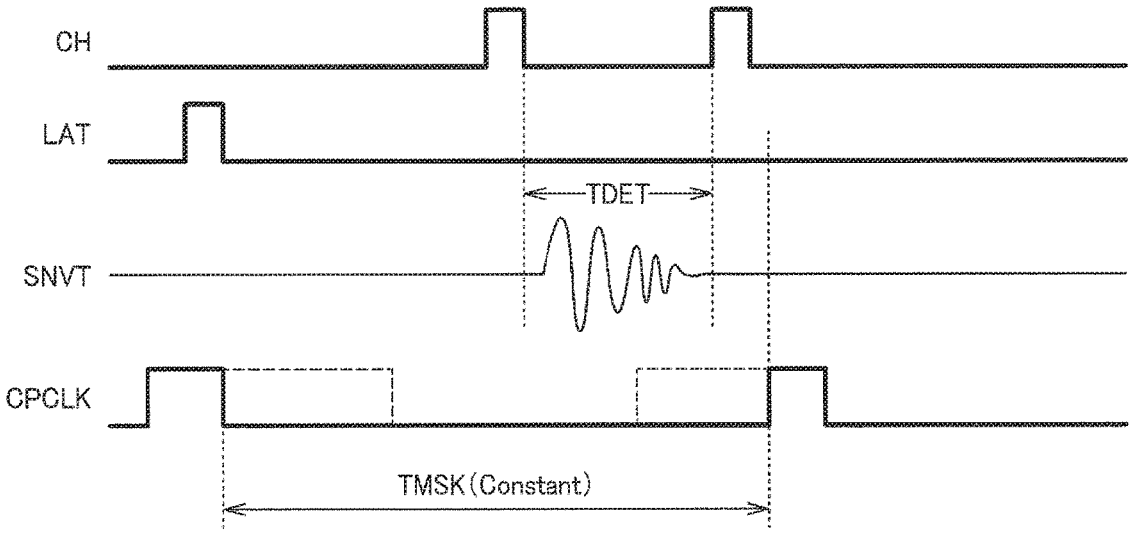
FIG. 8 is a timing chart for illustrating operations of the control circuit.

The operations of the control circuit 172 will be described using FIGS. 7 and 8. FIG. 6 is also referred to, as appropriate.

The clock generator 165 generates a clock signal CKG by dividing the clock signal MCK from the oscillator circuit 173.

The monitoring unit 161 monitors the control signals LAT and CH. For example, the monitoring unit 161 detects toggle timings and the number of toggles of the control signals LAT and CH.

The mode determination unit 163 determines whether or not the mode is the detection mode based on a result of monitoring performed by the monitoring unit 161. As shown in FIG. 6, when falling of the control signal LAT has been detected by the monitoring unit 161 in a predetermined mode, the mode determination unit 163 determines that the mode is the detection mode.

The switching signal generator 162 outputs the gate driving signal PMD based on a result of monitoring performed by the monitoring unit 161. As shown in FIG. 6, when the monitoring unit 161 has detected that the control signal LAT has fallen after the control signal LAT first rose in the detection mode, the switching signal generator 162 changes the level of the gate driving signal PMD from a low level to a high level.

The clock suspension determination unit 164 outputs a clock suspension signal based on a result of determination made by the mode determination unit 163 and the gate driving signal PMD from the switching signal generator 162. The clock suspension determination unit 164 activates the clock suspension signal when the mode determination unit 163 has determined that the mode is the detection mode, and the level of the gate driving signal PMD has changed from a low level to a high level.

The selector SWCK selects the clock signal CKG when the clock suspension signal is deactivated. That is, the clock signal CKG is output as the step-up clock signal CPLCK. On the other hand, when the clock suspension signal is activated, the selector SWCK selects a low level. That is, the step-up clock signal CPLCK is fixed to a low level. Note that, in the waveform of the step-up clock signal CPLCK in FIG. 8, the waveform in the present embodiment is indicated by the solid line. Also, the waveform if the step-up clock signal CPLCK is not stopped is indicated by the dotted line.

As described above, the timing at which the step-up clock signal CPLCK stops is a timing at which the control signal LAT first rises in the detection mode.

The period in which the step-up clock signal CPLCK is suspended is referred to as a clock suspension period TMSK. In FIG. 8, the clock suspension period TMSK is a fixed period. That is, the clock suspension determination unit 164 deactivates the clock suspension signal upon detecting that a fixed period has passed after the clock suspension period TMSK started using a timer or the like. With this, the step-up clock signal CPLCK is re-started. Note that the fixed period is set such that the clock suspension period TMSK includes the detection period TDET.

Note that the clock suspension period TMSK is not limited to a fixed period. Hereinafter, an example of the case where the clock suspension period TMSK is not a fixed period will be described.

Figure 9:
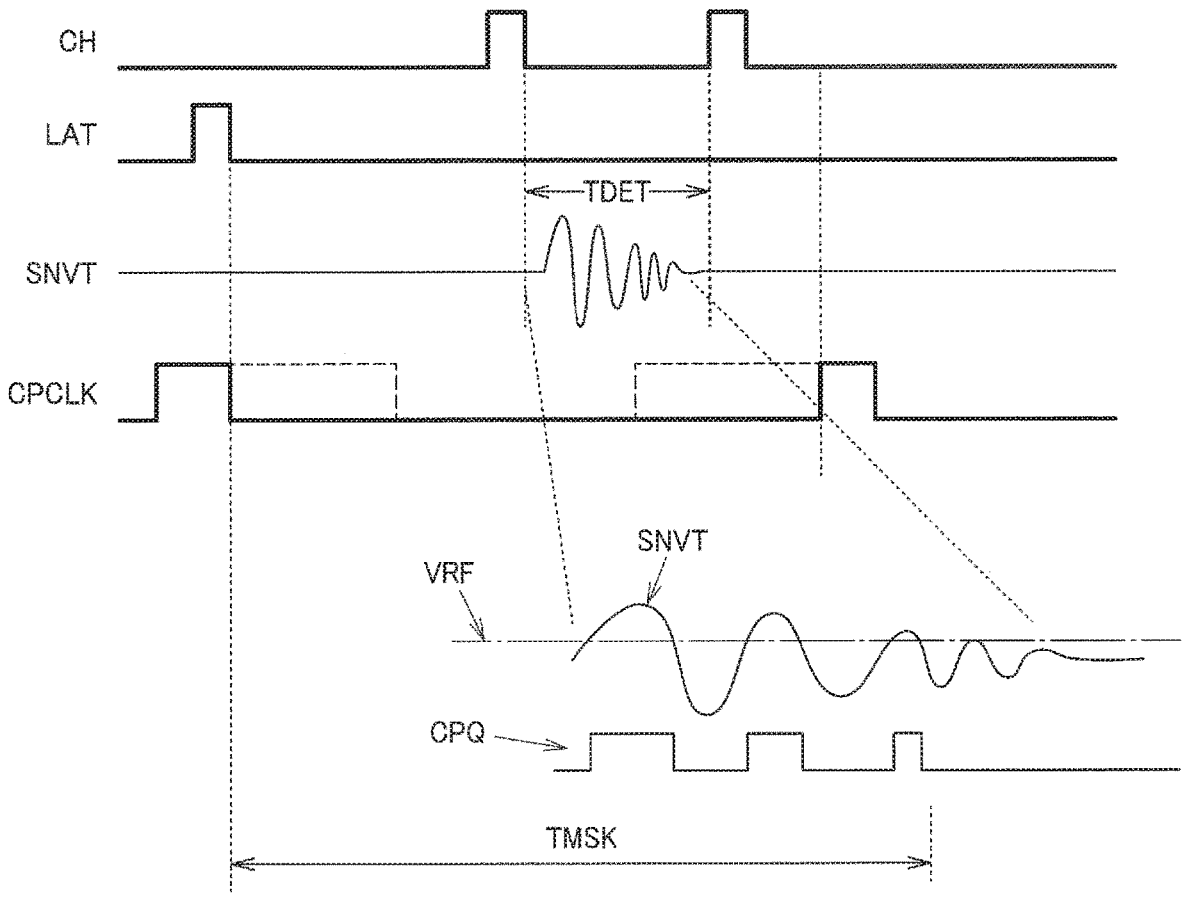
FIG. 9 is a timing chart when a clock suspension period is ended based on a comparison result signal.

FIG. 9 is a timing chart when the clock suspension period TMSK is ended based on the comparison result signal CPQ. In this example, the clock suspension determination unit 164, upon detecting that toggling of the comparison result signal CPQ no longer occurs, deactivates the clock suspension signal. With this, the step-up clock signal CPLCK can be suspended while the comparison result signal CPQ toggles.

Figure 10:
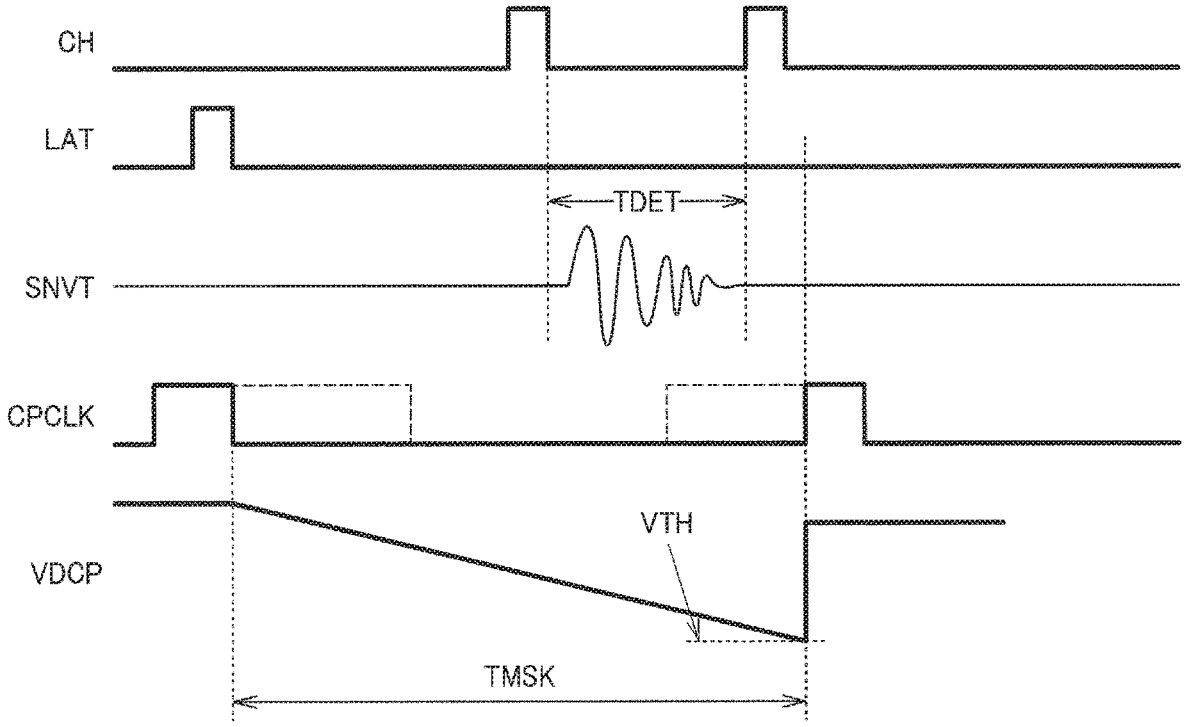
FIG. 10 is a timing chart when a clock suspension period is ended based on a boosted voltage.

FIG. 10 shows a timing chart when the clock suspension period TMSK is ended based on the boosted voltage VDCP. In this example, the monitoring circuit 176 in FIG. 5 detects whether or not the boosted voltage VDCP is less than or equal to a threshold voltage VTH. When the boosted voltage VDCP is detected to be less than or equal to the threshold voltage VTH, the clock suspension determination unit 164 deactivates the clock suspension signal. With this, because the boosted voltage VDCP can be kept to be greater than or equal to the threshold voltage VTH, an anomalous operation or the like due to the reduction of the boosted voltage VDCP can be prevented.

5. Layout

Figure 11:
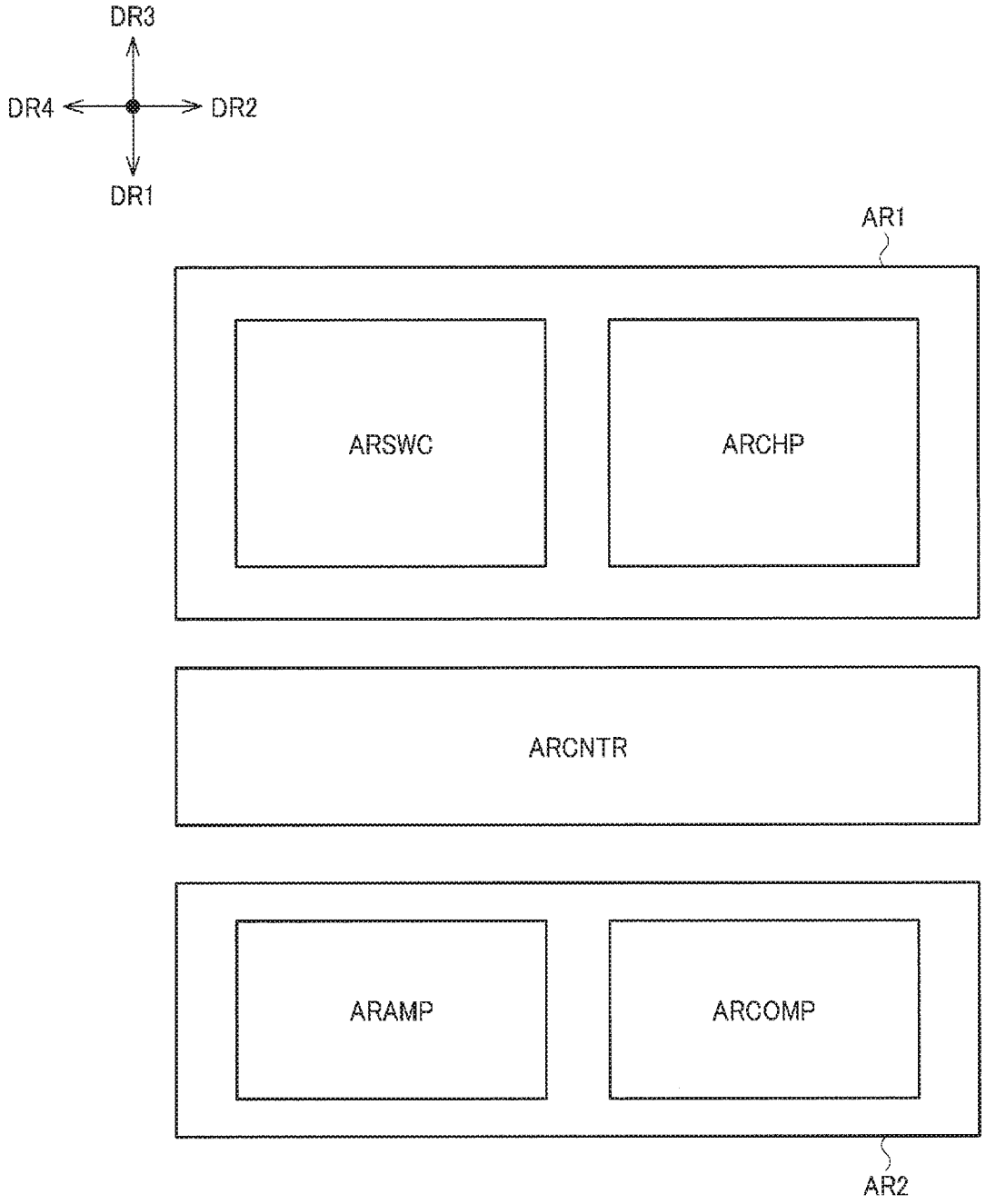
FIG. 11 shows an exemplary layout arrangement of the integrated circuit device.

FIG. 11 shows an exemplary layout arrangement of the integrated circuit device 150. FIG. 11 is a plan view seen in a thickness direction of the substrate of the integrated circuit device 150. Note that FIG. 11 schematically shows the layout arrangement, and the layout arrangement need not strictly be in this arrangement.

In FIG. 11, a direction orthogonal to a first direction DR1 is denoted as a second direction DR2. Also, a direction opposite to the first direction DR1 is denoted as a third direction DR3, and a direction opposite to the second direction DR2 is denoted as a fourth direction DR4. Note that an "area" to be used in the following refers to an area in which elements that constitute circuits are arranged. For example, a transistor, an interconnect, a resistor, and a capacitor are arranged in the area.

As shown in FIG. 11, an area ARCNTR is arranged on the first direction DR1 side of an area AR1, and an area AR2 is arranged on the first direction DR1 side of the area ARCNTR.

An area ARSWC in which the switch unit 151 is arranged and an area ARCHP in which the voltage boosting circuit 171 is arranged are arranged in the area AR1 That is, the switch circuits SELCH1, TG1, SELCH2, and TG2, which are first to fourth switch circuits, and the voltage boosting circuit 171 are arranged in the area AR1. The area ARCHP is arranged on the second direction DR2 side of the area ARSWC.

An area ARAMP in which the excited signal amplifier 152 is arranged and an area ARCOM in which the excited anomalous signal processor 153 is arranged are arranged in the area AR2. That is, the analog front end circuit is arranged in the area AR2. Specifically, the amplifier circuit APC, the bandpass filter BPF, the comparators CP1 and CP2, and the D/A converter circuit DAC are arranged in the area AR2.

The control circuit 50 is arranged in the area ARCNTR. That is, the control circuit 172 is arranged between the voltage boosting circuit 171 and the switch circuits SELCH1, TG1, SELCH2, and TG2, and the analog front end circuits. Note that there is no limitation thereto, and it is sufficient that the control circuit 172 is arranged between the voltage boosting circuit 171 and the analog front end circuit, or the control circuit 172 is arranged between the switch circuits SELCH1, TG1, SELCH2, and TG2 and the analog front end circuit. Also, in FIG. 11, the control circuit 172 is arranged only in an area between the area AR1 and the area AR2, but there is no limitation thereto. For example, a portion of the control circuit 172 may be arranged between the area AR1 and the area AR2. That is, the remaining portion of the control circuit 172 may be arranged on the second direction DR2 side or the like of the area AR1 or area AR2.

According to this exemplary arrangement, as a result of the control circuit 172 being arranged between the voltage boosting circuit 171 or the switch circuits SELCH1, TG1, SELCH2, and TG2 and the analog front end circuit, noise can be suppressed from propagating from the voltage boosting circuit 171 or the switch circuits SELCH1, TG1, SELCH2, and TG2 to the analog front end circuit.

In the embodiment described above, an integrated circuit device includes a first terminal, a first switch circuit, an amplifier circuit, a voltage boosting circuit, and a control circuit. The first terminal is connected to a driving signal line of a driving circuit that drives an actuator of a nozzle. The nozzle discharges a liquid droplet as a result of a vibrating plate being displaced by the actuator. One end of the first switch circuit is connected to the first terminal. The amplifier circuit receives an output signal from the other end of the first switch circuit, and amplifies an induced voltage generated in the actuator due to residual vibration of the vibrating plate after the actuator having been driven. The voltage boosting circuit generates a boosted voltage for level-shifting a switching signal of the first switch circuit based on a step-up clock signal. The control circuit controls the voltage boosting circuit and the first switch circuit.

According to the present embodiment, the integrated circuit device including the amplifier circuit is configured as an IC that is separate from a head driver IC. Accordingly, the integrated circuit device can be formed with a low voltage process that is different from a high voltage process for the head driver IC.

Also, in the present embodiment, the control circuit may suspend outputting of the step-up clock signal in a detection period of the induced voltage.

In this way, outputting of the step-up clock signal and switching operation of the voltage boosting circuit are suspended in the detection period in which the induced voltage is detected. With this, an anomalous nozzle can be detected without being influenced by noise, and it is possible to accurately detect an anomalous nozzle.

Also, in the present embodiment, the integrated circuit device may include a monitoring circuit that monitors the boosted voltage. The control circuit may re-start outputting of the step-up clock signal based on a monitoring result of the monitoring circuit.

In this way, if the boosted voltage satisfies a predetermined condition, the operation of the voltage boosting circuit can be re-started. For example, as a result of re-starting the operation of the voltage boosting circuit when the boosted voltage becomes less than or equal to a threshold voltage, the boosted voltage can be kept at a voltage that is higher than or equal to the threshold voltage.

Also, in the present embodiment, the integrated circuit device may include a control signal input terminal to which a control signal from a host device that controls the driving circuit using the control signal is input. The control circuit may control the first switch circuit based on the control signal.

In this way, the control signal from the host device can be input to the integrated circuit device through the control signal input terminal. Also, the control circuit can control the first switch circuit based on the control signal. That is, the control signal is a signal for the host device to control the driving circuit when normal printing is performed. As a result of providing the control signal input terminal, the control circuit can monitor this control signal. Also, when the waveform for setting the detection mode of the integrated circuit device is output as the control signal, the control circuit can recognize the detection mode based on the control signal. Also, the control circuit can control the first switch circuit based on the recognition result.

Also, in the present embodiment, the control circuit may determine the detection period of the induced voltage based on the control signal.

The residual vibration of the actuator is vibration that occurs after the actuator has been driven. Since the control signal is a signal for controlling driving of the actuator by the driving circuit, the control circuit can recognize the timing at which the residual vibration occurs by monitoring the control signal. That is, the control circuit can determine the detection period of the induced voltage based on the control signal.

Also, in the present embodiment, the control circuit may control the step-up clock signal based on the control signal.

As described above, the control circuit can recognize the timing at which the residual vibration occurs by monitoring the control signal. That is, the control circuit can suspend the step-up clock signal in the detection period by controlling the step-up clock signal based on the control signal.

Also, in the present embodiment, the integrated circuit device may include a filter and a comparator. The filter may perform filtering processing on the output of the amplifier circuit. The comparator may compare the signal subjected to the filtering processing with a reference voltage.

In this way, inside the integrated circuit device, the induced voltage generated due to residual vibration is amplified by the amplifier circuit and is converted to a digital signal by a comparator. With this, digital signals can be transmitted from a head circuit board to a main circuit board in the main body of a liquid droplet ejection device. With this, the noise immunity can be improved compared with a known technology in which analog signals are transmitted from the head circuit board to the main circuit board in the main body of the liquid droplet ejection device.

Also, in the present embodiment, the integrated circuit device may include an output terminal from which the comparison result is output to the host device that controls the driving circuit.

In this way, the integrated circuit device can output the result of comparison made by the comparator to the host device. The result of comparison corresponds to the aforementioned digital signal. As described above, the noise immunity can be improved compared with a known technology in which analog signals are transmitted from the head circuit board to the main circuit board in the main body of the liquid droplet ejection device.

Also, in the present embodiment, the integrated circuit device includes a buffer circuit and a level shifter. The buffer circuit may drive a gate of a transistor provided between an actuator-side driving signal line that is connected to the actuator and a driving signal line of the driving circuit. The level shifter may level-shift the gate driving signal from the control circuit based on a boosted voltage, and output the level-shifted signal to the buffer circuit.

In such a configuration, a boosted voltage is needed in order to supply a boosted voltage to the level shifter. According to the present embodiment, as described above, outputting of the step-up clock signal and the switching operation of the voltage boosting circuit are suspended in the detection period in which the induced voltage is detected. With this, an anomalous nozzle can be detected without being influenced by noise, and it is possible to accurately detect an anomalous nozzle.

Also, in the present embodiment, the integrated circuit device may include a second terminal, a second switch circuit, and a control signal input terminal. The second terminal may be connected to an actuator-side driving signal line that is connected to the actuator. One end of the second switch circuit may be connected to the first terminal. The other end of the second switch circuit may be connected to the second terminal. A control signal from the host device that controls the driving circuit using the control signal may be input to the control signal input terminal. The control circuit may control the second switch circuit based on the control signal.

In this way, as a result of providing the control signal input terminal, the control signal from the host device can be input to the integrated circuit device. Also, the control circuit can control the second switch circuit based on the control signal. When the second switch circuit is turned off, because the first terminal is cut off from the second terminal, the induced voltage input from the first terminal is input to the amplifier circuit through the first switch circuit. Such control can be performed based on the control signal.

Also, in the present embodiment, the control circuit may be arranged between the voltage boosting circuit or the first switch circuit and an analog front end circuit including the amplifier circuit.

It is possible that noise from the voltage boosting circuit or the first switch circuit propagates to the analog front end circuit through a substrate or the like of the integrated circuit device, for example. According to the present embodiment, since the control circuit is arranged between the voltage boosting circuit or the first switch circuit and the analog front end circuit, propagation of noise can be suppressed.

Also, in the present embodiment, the liquid droplet ejection device includes the integrated circuit device according to any of the above descriptions, a driving circuit, and a head including a nozzle.

Note that although an embodiment has been explained in detail above, a person skilled in the art will readily appreciate that it is possible to implement numerous variations and modifications that do not depart substantially from the novel aspects and effect of the invention. Accordingly, all such variations and modifications are also to be included within the scope of the invention. For example, terms that are used within the description or drawings at least once together with broader terms or alternative synonymous terms can be replaced by those other terms at other locations as well within the description or drawings. Also, ail combinations of the embodiment and variations are also encompassed in the range of the invention. Moreover, the configuration and operation of the integrated circuit device and the liquid droplet ejection device are not limited to those described in the present embodiment, various modifications are possible.

What is claimed is:

1. An integrated circuit device comprising:

a first terminal connected to a driving signal line of a driving circuit that drives an actuator of a nozzle that discharges a liquid by causing the actuator to displace a vibrating plate;

a first switch circuit whose one end is connected to the first terminal;

an amplifier circuit that receives an output signal from another end of the first switch circuit, and amplifies an induced voltage of the actuator generated due to residual vibration of the vibrating plate after the actuator having been driven;

a voltage boosting circuit connected to the amplifier circuit, the voltage boosting circuit generating a boosted voltage for level-shifting a switching signal of the first switch circuit based on a step-up clock signal;

a control circuit that controls the voltage boosting circuit and the first switch circuit;

a buffer circuit that drives a gate of a transistor provided between an actuator-side driving signal line connected to the actuator and the driving signal line of the driving circuit; and a level shifter that level-shifts a gate driving signal from the control circuit based on the boosted voltage, and outputs a level-shifted signal to the buffer circuit.

2. The integrated circuit device according to claim 1, wherein the control circuit is configured to detect the induced voltage in a detection period, and the control circuit suspends outputting of the step-up clock signal in the detection period of the induced voltage.

3. The integrated circuit device according to claim 2, further comprising:

a monitoring circuit that monitors the boosted voltage, wherein the control circuit re-starts outputting of the step-up clock signal based on a result of monitoring performed by the monitoring circuit.

4. The integrated circuit device according to claim 1, further comprising:

a control signal input terminal to which a control signal is input from a host device that controls the driving circuit using the control signal, wherein the control circuit controls the first switch circuit based on the control signal.

5. The integrated circuit device according to claim 4, wherein the control circuit is configured to detect the induced voltage, and the control circuit determines a detection period for detecting the induced voltage based on the control signal.

6. The integrated circuit device according to claim 4, wherein the control circuit controls the step-up clock signal based on the control signal.

7. The integrated circuit device according to claim 5, wherein the control circuit controls the step-up clock signal based on the control signal.

8. The integrated circuit device according to claim 1, further comprising:

a filter that performs filtering processing on an output of the amplifier circuit; and a comparator that performs comparison between the output that is subjected to the filtering processing and a reference voltage.

9. The integrated circuit device according to claim 7, further comprising:

an output terminal from which a result of the comparison is output to a host device that controls the driving circuit.

10. The integrated circuit device according to claim 1, further comprising:

a second terminal connected to an actuator-side driving signal line connected to the actuator;

a second switch circuit whose one end is connected to the first terminal and another end is connected to the second terminal; and a control signal input terminal to which a control signal from a host device that controls the driving circuit using the control signal is input, wherein the control circuit controls the second switch circuit based on the control signal.

11. The integrated circuit device according to claim 2, further comprising:

a second terminal connected to an actuator-side driving signal line connected to the actuator;

a second switch circuit whose one end is connected to the first terminal and another end is connected to the second terminal; and a control signal input terminal to which a control signal from a host device that controls the driving circuit using the control signal is input, wherein the control circuit controls the second switch circuit based on the control signal.

12. The integrated circuit device according to claim 1, wherein the control circuit is arranged between the voltage boosting circuit or the first switch circuit and an analog front end circuit including the amplifier circuit.

13. A liquid droplet ejection device comprising:

the integrated circuit device according to claim 1;

the driving circuit; and a head including the nozzle.

* * * * *